United States Patent [19]

Schildge, Jr.

[11] Patent Number: 5,010,695

[45] Date of Patent: Apr. 30, 1991

[54] CABLE-STAY ROOF FOR STADIUM OR ARENA AND METHOD OF CONSTRUCTION OF SAME

[76] Inventor: Adam T. Schildge, Jr., 899 Green St., San Francisco, Calif. 94133

[21] Appl. No.: 462,831

[22] Filed: Jan. 10, 1990

[51] Int. Cl.[5] ..... E04H 3/10; E04B 7/14

[52] U.S. Cl. ..... 52/6; 52/73; 52/83; 52/745; 52/747

[58] Field of Search ..... 52/6, 741, 745, 747, 52/73, 83

[56] References Cited

U.S. PATENT DOCUMENTS

| | | | |
|---|---|---|---|
| D. 260,036 | 7/1981 | Schildge, Jr. . | |
| D. 270,570 | 9/1983 | Schildge, Jr. . | |
| D. 274,841 | 7/1984 | Schildge, Jr. . | |
| D. 274,842 | 7/1984 | Schildge, Jr. . | |
| D. 274,843 | 8/1984 | Schildge, Jr. . | |
| 1,274,987 | 8/1918 | Carroll . | |
| 1,419,868 | 6/1922 | Levitan . | |
| 2,126,413 | 8/1938 | Respess . | |
| 2,574,307 | 11/1951 | Whelan . | |
| 2,881,718 | 4/1959 | Stromeyer . | |
| 3,330,201 | 7/1967 | Mouton, Jr. | 52/6 |
| 3,477,183 | 11/1969 | Graham . | |
| 3,579,932 | 5/1971 | Atkinson | 52/6 |
| 3,619,958 | 11/1971 | Viesi | 52/6 |
| 4,535,498 | 8/1985 | Webster . | |
| 4,651,496 | 3/1987 | Schildge, Jr. . | |
| 4,802,314 | 2/1989 | Schildge, Jr. . | |

FOREIGN PATENT DOCUMENTS

| | | |
|---|---|---|
| 202879 | 6/1956 | Australia . |
| 302005 | 11/1917 | Fed. Rep. of Germany . |
| 1230062 | 12/1966 | Fed. Rep. of Germany . |

OTHER PUBLICATIONS

Raum Liche Tragwerke Aug Stahl 1963, pp. 186, 187, 198, 199 TH/385/M3.

Der Stahlbau 9/1965, p. 265.

Architectural Forum, Jul. 1964, "Nervi Gives a Factory the Grace of a Bridge", p. 111.

Cable Roof Structures, Bethlehem Steel, 1968, pp. 40, 41, 43, 44.

Suspended Structures Concepts, U.S. Steel, 1966, pp. 10 and 11.

The Cantilever Construction of Prestressed Concrete Bridges, Michael Mathivat, 1983, pp. 325, 327, TG/384/M3.

*Primary Examiner*—Michael Safavi

*Attorney, Agent, or Firm*—Limbach, Limbach & Sutton

[57] ABSTRACT

A roof structure and method of constructing the same wherein a large clear span is built over an existing or new athletic stadium or arena. The principal feature of the roof structure is that it is supported by Cable-Stays to towers standing outside of the stadium and places no additional weight on the existing stadium. The invention is particularly concerned with such a method and structure wherein the central section of the structure is not cantilevered from the towers and thus does not impart cantilever loads to the towers. The structure includes a beam framework and roof covering installed over the framework. The covering is fabricated of a clear skylight material to allow sufficient light transmission to permit a natural grass playing field and is openable to allow for ventilation.

8 Claims, 6 Drawing Sheets

CABLE-STAY ROOF FOR STADIUM OR ARENA AND METHOD OF CONSTRUCTION OF SAME

TECHNICAL

The invention relates to the structure and the method of construction of a large span steel or other material framed roof built over an athletic stadium or arena. The roof structure is supported by steel Cable-Stays to towers set outside the stadium and to ground anchors. The method of construction is a cantilevering method. The technology utilized is Cable-Stay Technology. The invention is particularly concerned with such a roof structure and method wherein an intermediate section of the structure is Cable-Stay suspended without imparting significant cantilever load to the towers.

RELATED PATENT

This application relates to my U.S. Pat. No. 4,802,314 and is an improvement over the invention forming the subject of that patent in the manner in which the center of the roof is suspended and the staging technique used for erecting the roof.

BACKGROUND OF THE INVENTION

The erection of structures utilizing suspension cables or Cable-Stay Technology has existed for some time. For example, many bridges utilize cables extending between towers or from a single tower to suspend a roadway. In addition, many buildings have been designed such that the roof structure is supported by cables. The principal advantage of utilizing cables to support a roof is that large covered buildings can be designed without any internal supports; and quite economically. One example of a structure which benefits from this type of design is an airplane hanger which requires a large area without pillars to permit positioning aircraft. Sporting arenas also benefit from this design since the design provides for unobstructed viewing.

Examples of roof structures designed by the applicant with Cable-Stay Technology can be found in the following design U.S. Pat. Nos.: D260,036, issued Jul. 28, 1981; D270,570, issued Sept. 13, 1983; D 274,841, issued Jul. 24, 1984; D274,842, issued Jul. 24, 1984; D274,843, issued Jul. 24, 1984; and in current utility U.S. Pat. Nos. 4,651,496 issued Mar. 24, 1987 and 4,802,314 issued Feb. 7, 1989.

The design patents above relate to the ornamental appearance of Cable-Stay supported structures.

The utility patents above relate to methods of construction of Cable-Stay roofs over existing stadiums or arena and their design.

Also made reference to is pending design patent application filed May 8, 1987 under Ser. No. 047,064 which covers the ornamental appearance of the Cable-Stay supported structure in utility patent U.S. Pat. No. 4,802,314.

The invention of this application relates to the construction of a Cable-Stay roof over an existing or new stadium or arena, or other structure and to the method of its construction.

Recently there has been significant amount of interest in covering existing as well as new open air athletic stadiums. As can be appreciated, many stadiums are located in areas where weather conditions make it difficult to hold events whenever desired.

Existing open air stadiums are generally not designed to support the weight of a newly added roof. Thus, in order to build a roof over an existing stadium, significant measures have to be taken to reinforce the stadium walls or build an additional support system. The latter steps, even if possible, can be difficult and expensive. With new stadiums this can be less of a problem.

There has been significant interest in making these roofs retractable or at least openable for ventilation.

Also there has been interest in providing means of retaining a natural grass playing field on the stadium floor both in existing stadiums as well as in new stadiums.

Accordingly, it is an object of the subject invention to provide a new and improved method for constructing such a roof over an existing or new stadium or arena, or other structure.

It is an object of this invention to provide a means of constructing such a roof that is both functional and cost effective to build.

It is an object of this invention to provide a new and improved method of constructing a cable roof structure over an existing or new stadium or arena, which structure will provide unobstructed viewing within the stadium.

It is still another object of this subject invention to provide a new and improved method of constructing a cable roof structure over an existing or new stadium, which structure is capable of supporting a glass or a clear plastic roof cover to allow for the retention or use of a natural grass cover on the playing field and to provide as well for the public enjoyment by creating an outdoor atmosphere.

It is also another object of this invention to provide a new and improved method of constructing a Cable-Stay structure over an existing or new stadium, which structure is capable of supporting a partially retractable cover or one that opens sufficiently for ventilation.

It is further the object of this invention to provide a roof that allows for natural ventilation by keeping parts permanently open such that costly heating and air handling equipment might not be necessary.

It is further the object of this invention to provide a clear skylight roof cover such that costly additional lighting is not necessary in an existing stadium where tower lighting exists and can project through the skylight roof. It is also the object of this invention to provide a roof that could support a restaurant and/or sightseeing walkways on its surface.

It is also the object of this invention to provide a roof that could support luxury private seating boxes suspended from the roof structure.

It is also the object of this invention to provide a roof that is structurally sound to withstand, besides its own weight and design loading, also high earthquake forces and unusual wind forces, and snow loading.

It is also the object of this Invention to build a roof that can be built by available technology and contractor's experience, available in the marketplace.

It is also the object of this invention to provide a roof that is permanent and has a long life.

It is also the object of this invention to provide a roof that has relatively low operating and maintenance costs.

It is also the object of this invention to provide a roof that can be aesthetically pleasing.

Another and more specific object of the invention is to provide a roof structure and method of fabricating the same wherein first and second Cable-Stay suspended sections of the structure are cantilevered toward one another from oppositely disposed towers and an intermediate section of the structure is Cable-Stay suspended between the first and second sections without imparting significant cantilever loads to the towers.

Another and more general object of the invention is to provide a roof structure including cantilevered sections wherein cantilever loads are reduced by suspending a portion of the structure in tension from Cable-Stays.

SUMMARY OF INVENTION

In accordance with these and many other objects, the subject invention provides a structural design and a method of constructing such a roof over an existing or new stadium.

The structural design is a roof of clear span over the stadium and supported by Cable-Stays to towers outside the stadium and to ground anchors. The roof cover is either clear plastic or glass but could be of other material and is made partially retractable or openable for ventilation. The roof is outfitted with permanent ventilation louvers where needed and made to overlap the stadium rim it covers allowing a gap between the roof and the stadium rim for ventilation and overlapping in such a way that it also provides partial protection to concourse and other areas around the stadium.

The assembly of the roof structure is accomplished by first constructing two rows of parallel or curved towers on opposite sides of the stadium and tangent to the stadium and then extending Cable-Stays from the towers to ground anchors outside the stadium. Cable-Stays are then extended from these towers and slanted into the stadium to support long-beam framing for a roof section cantilevered from each tower and held back in compression thereagainst. An intermediate roof section is then suspended between the cantilevered sections in tension by cable stays extending to the towers. The framing for the roof sections may take any of a number of forms. As an example, it may be open web steel joists or it may be a space frame or it may be box steel framing or another framing system. The cantilever construction can be from one side of the stadium and then from the other or from both sides simultaneously. At completion of the cantilevered sections, the distal edges thereof are spaced to define an open span gap between the sections. The intermediate section is suspended within this gap and includes central long-beam framing members which are tension connected to Cable-Stays connected to the towers. In the preferred embodiment, the intermediate section is connected to the cantilevered sections with infill members which have connections at either end or at one end to allow for expansion and contraction and other movement. In this manner a stable roof framing is constructed across the stadium from both sides. The roof framing is therewith complete, with the cantilevered sections left free to press against the tower legs and both the cantilevered and intermediate sections gaining their support from Cable-Stays to the towers and in turn to ground anchors. The intermediate section is suspending in tension without imparting cantilever forces to the towers.

In practice the roof members are lifted onto the roof by a ground crane and cables attached to the long beam framing members are then connected to the towers by also another ground crane or by a crane on top of the towers, a top crane. The ground cranes can work from either outside or inside the stadium whichever offers the best accessibility. After the completed roof framing is in place, a roof cover of either glass or clear plastic skylight material or other material is installed over the framing. This is also lifted onto the roof by the ground crane or it may be installed by helicopter.

Sections of the roof are made retractable by sliding sections over other sections on rails and controlling the operation remotely.

Retractability or ventilation may also be achieved by remote controlled hinged door type openings, the preferred method, or any other means.

Lighting towers if present are left in place and existing lighting continues to illuminate the stadium by simply projecting through the clear skylight roof. Additional lighting where needed is added as well on the underside of the roof.

A grass playing field if present is retained.

The roof is made to overlap the existing or new stadium for ventilation and for partial protection of surrounding concourse areas.

The roof is provided with ventilation louvers as needed.

Elevators in the towers are provided for access to the roof and tower tops.

Walkways with handrails on the roof beams are constructed for maintenance and sightseeing.

A restaurant is built on the roof as desired.

Luxury private seating boxes are built suspended from the roof where desired.

High pressure water jets are installed on the roof for roof cleaning.

Where desired to completely close the roof to the stadium a flexible gasket is attached between the roof and the stadium rim.

BRIEF DESCRIPTION OF THE DRAWINGS

Further objects and advantages will become apparent from the following detailed description taken in conjunction with the drawings in which.

REFERENCE NUMBERS

Figures 1, 2:
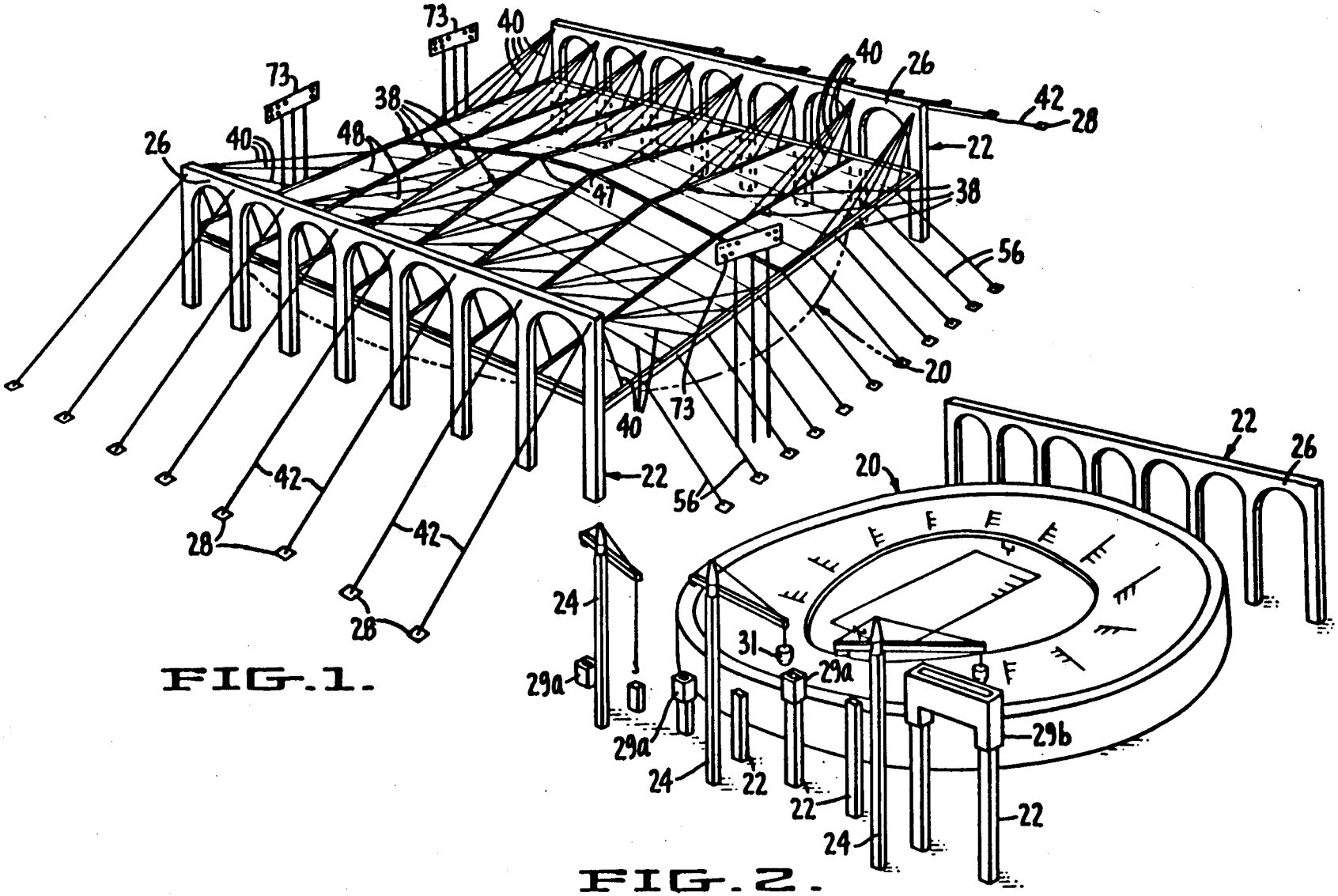
FIG. 1 is a perspective view of the Cable-Stay roof as set over an existing or new stadium or arena.
FIG. 2 is a perspective view of the support towers under construction set alongside the existing or new stadium or arena.

16: piles
18: foundations
20: stadium
22: towers
24: tower cranes
26: arches
28: ground anchors
**29*a***: slip form
**29*b***: slip form
30: ground crane
31: bucket
34: top crane
36: site where roof framing is assembled for lifting to the roof
38: roof long-beam framing
**38*a***: initial long-beam framing member
40: Cable-Stays to roof framing
41: distal edges
42: Cable-Stays to anchors or back-stays
43: open span gap
48: intermediate roof framing
50: roof covering, preferably a clear skylight
**50*a***: slidable roof sections
51: cable
52: point where roof long-beam framing meets towers
54: cross-cables or struts for cable vibration dampening and enhanced structural stiffness as well as vibration noise control
56: hold-down cables at roof edge providing also partial lateral sidesway support.
57: bolts
58: suspended luxury boxes for private seating
60: roof restaurant
62: water jets for roof cleaning
72: flexible closure gasket between stadium rim and roof
73: stanchion lighting
76: a boatswains chair or basket for access to cables for maintenance
78: a typical hinged type clear plastic roof bubble openable for ventilation
79: hydraulic cylinders
80: tower elevator
81: infrared radiant heaters
82: expansion and contraction joints
84: intermediate roof section
86: central long-beam framing member
87: infill roof members
88: infill long-beam framing member
90: connecting links for infill framing members
92: connecting link bolts
94: connecting link nuts

DETAILED DESCRIPTION OF THE PREFERRED EMBODIMENT

Figure 13:
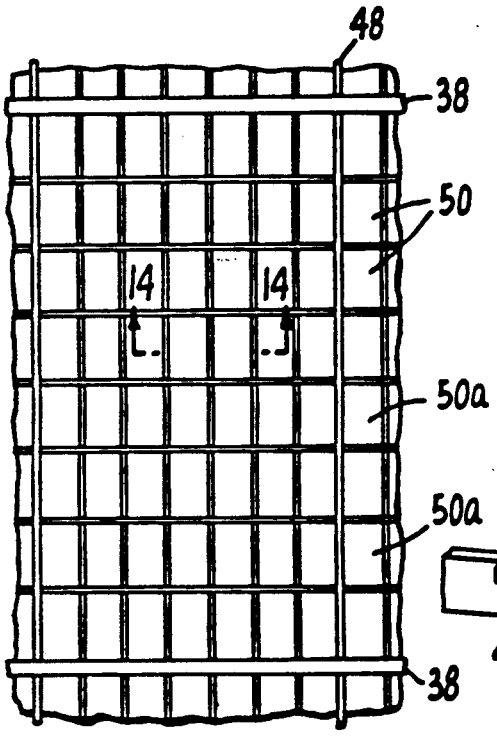
FIG. 13 is an expanded plan view of the intermediate framing between the long-beam framing members supporting the roof cover in the preferred method of using clear plastic bubble skylights approximately 7'-6" by 12' in dimension with each one operable by remote control for ventilation.
Figure 15:
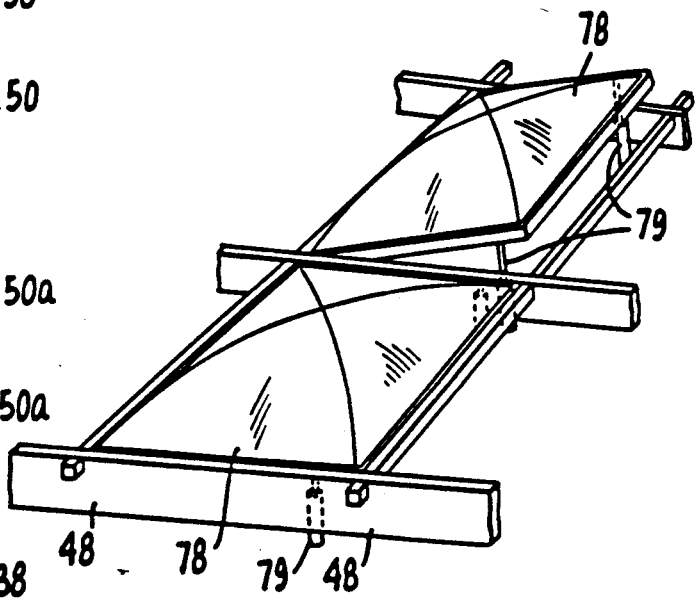
FIG. 15 is a perspective view of a typical skylight bubble and its hinged opening mode. On a large stadium there could be 6000 of these bubbles to make the entire roof.

Turning first to FIG. 1, the basic elements of the Cable-Stay roof structure of the subject invention will be briefly discussed. The Cable-Stay roof structure is intended to cover an existing or new open air stadium or arena shown generally by the numeral 20. The Cable-Stay roof structure comprises two rows of towers 22 set in parallel rows on opposite sides of the stadium 20. The towers in each row are connected by arches 26 and rest on foundations 18 and, when needed, piles 16. The roof structure long-beam framing 38 is suspended by CableStays 40 from the towers 22 and or their arches 26. This structure is further supported by back-stays 42 to ground anchors 28. Between the long-beam framing 38 is intermediate roof framing 48. Over the roof structure 38 and 48 is a roof covering or membrane (see FIG. 13 and 15) made of glass or a clear plastic or any other material and in desired areas the roof cover is made partially retractable or openable for ventilation and with louvered vents where needed and with permanent open parts where needed.

Having identified the main elements of the Cable-Stay roof structure, the preferred method of assembling this structure over an existing or new stadium or arena will be described in detail.

Figure 3:
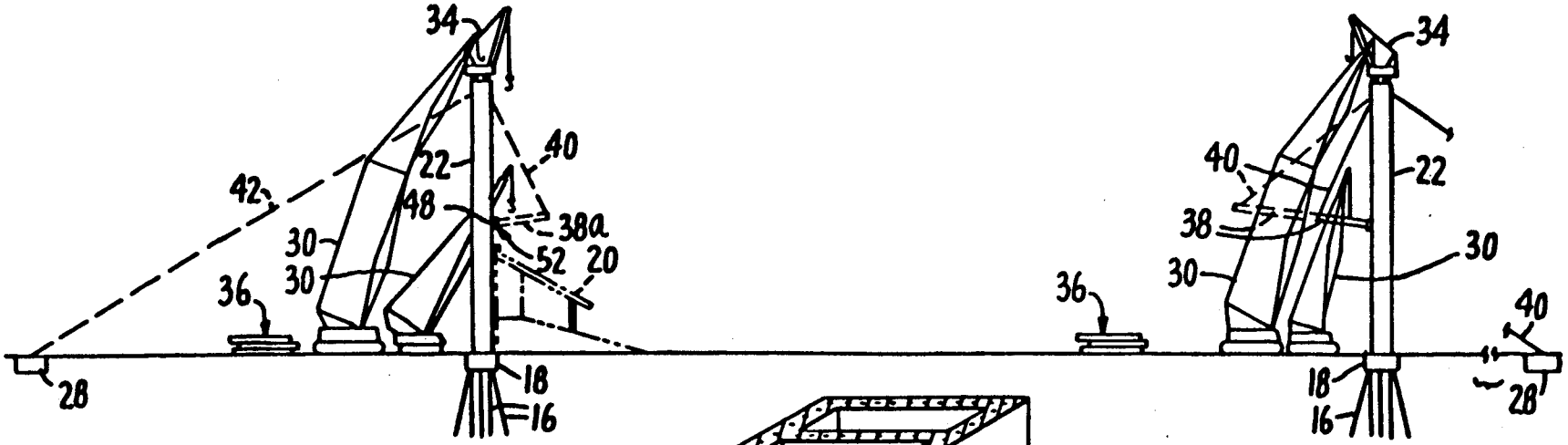
FIG. 3 is a diagrammatic elevational view showing the roof support towers and the initial sequence of the roof construction over a stadium by the cantilever method.

Starting with the stadium 20 in FIGS. 2 and 3, foundations 18, and piles 16 if needed are constructed exterior to the stadium 20. Over these foundations are constructed concrete or steel towers 22 with the use of tower cranes 24. The preferred embodiment has these towers as shown constructed from slip formed concrete in two parallel rows on opposite sides of the stadium. As an alternate they may be constructed in two curved planes on opposite sides of the stadium to more nearly fit to the shape of the stadium or they may be set in a circle, an ellipse, or other curved shape around the stadium or other structure. The preferred embodiment would have these tower rows at one point tangent to the stadium but they need not necessarily be tangent and can be set off from the stadium. The towers 22 are then connected at their top by arches 26 to one another for strength. The form of the connection need not necessarily take the form of an arch and could be a lintel, a truss, an angular brace, or any other form of reinforcement; and furthermore this entire connection can also be entirely left out such that the remaining structure of towers resemble simply rows of singular standing towers unconnected at their tops or free standing. Furthermore the towers need not necessarily be vertical, but could be tilted outward or even inward to the stadium for structural or architectural reasons. The slip forms as illustrated in FIG. 2 are designated by the numerals 29*a* and 29*b* and are shown as being filled with concrete by buckets 31 carried by the cranes 24.

Once the towers 22 are constructed the roof construction can begin. Although the illustrated embodiment shows roof construction commencing after both rows of towers have been completed, construction can begin after one row of towers is constructed on one side of the stadium. It follows from the drawings that the roof is then constructed inward from these towers by a cantilevered method, either from one side at a time or from both sides simultaneously. Material of the roof structure is raised to the roof from the stadium floor or from outside the stadium by ground cranes 30 and then installed in the cantilever method as each section is correspondingly connected by Cable-Stays to the tower tops. The Cable-Stays 40 are connected to the tower tops by the use of either a top crane 34 mounted on the tops of the towers or by a ground crane 30 reaching to the tops of the towers. The two cantilevered sections terminate at distal edges 41 short of the center of the roof structure and define therebetween an open span gap 43. An intermediate roof section 84 comprised of long-beam framing members 86 is suspended in tension within the gap 43 from Cable-Stays 40. Infill long-beam framing members 87 are connected between the intermediate section 84 and the cantilevered roof sections by stepped expansion and contraction joints 82. The joints 82 are secured against complete separation by connecting links 90 pivotally received on bolts 92 and secured in place by nuts 94. The weight of the intermediate section 84, as well as part of the weight of the infill members 87, is suspending directly from the towers 22 by the Cable-Stays 40. Depending on the breadth of the intermediate section, this can reduce the cantilever loads to the towers by forty percent or more, as contrasted to an arrangement where the full weight of the roof, including the spanning central section, is carried by the towers as a cantilever load.

At the same time as the tower construction is commencing, the ground anchors 28 which would be generally of steel, concrete, and pile construction are also constructed. Upon completion of the towers, either before or simultaneously with the commencement of roof construction (as herein described) back stay cables 42 are placed.

Figure 5:
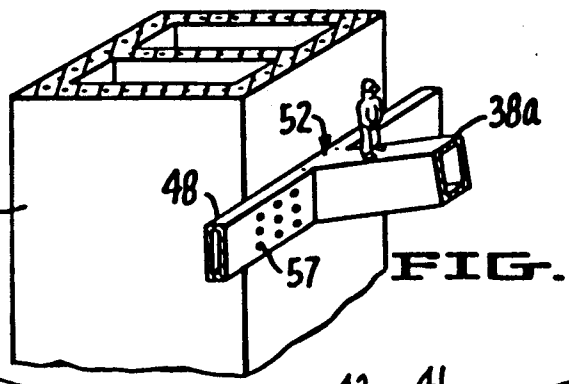
FIG. 5 is an enlarged perspective view, with parts broken away, of a roof long-beam framing member where connection is made to the tower leg.
Figure 4:
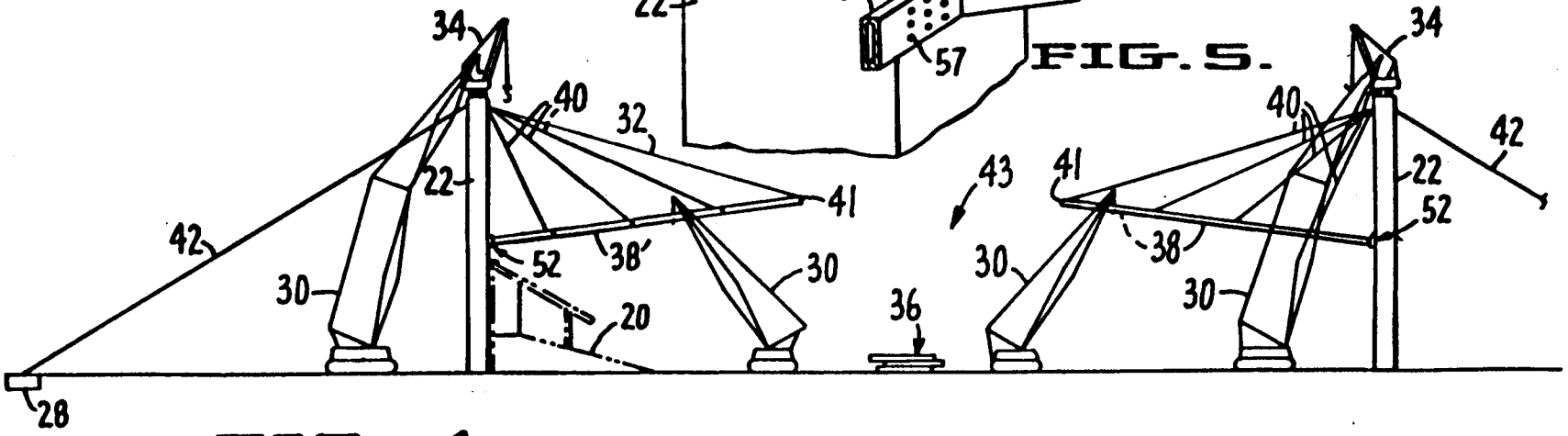
FIG. 4 is a diagrammatic elevational view similar to FIG. 3 showing continuing sequential steps in the cantilevered method in the process of setting the last segments of the cantilevered sections.
Figure 6:
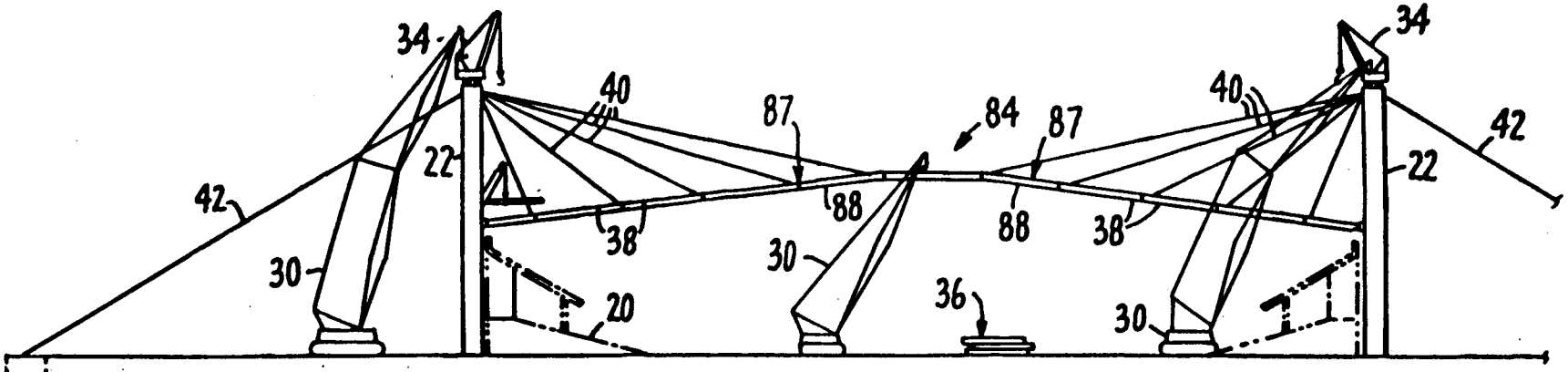
FIG. 6 is a diagrammatic elevational view similar to FIG. 3 and 4, showing the existing or new stadium or arena and the completed tower assemblies with the cantilevered roof structures complete and the intermediate roof section in the process of being suspended between the cantilevered structures and infill sections.
Figure 7:
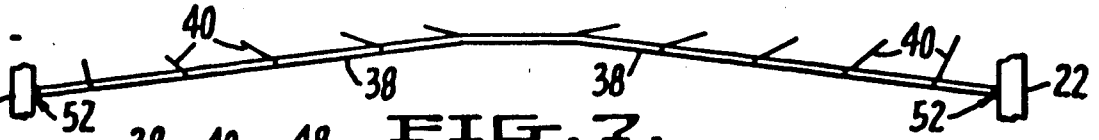
FIG. 7 is a diagrammatic elevational view, with parts broken away, showing the final roof with the framing with Cable-Stays completed.

Following these assemblages, the roof construction itself may now proceed as follows. Prefabricated roof material, generally of steel but also if desired of wood or of concrete or even of other structural material is assembled on the sites at 36 either inside or outside the stadium. Ground cranes 30, FIG. 3, then hoist an initial roof longbeam framing member 38*a* into position by hoisting it over the stadium rim between the towers and under the arches to a point on the roof and attaches one end of the framing member to a tower leg where it is connected at 52 (see FIG. 5). As an alternate method a ground crane can hoist the long-beam framing member 38*a* from within the stadium to the tower leg where it is attached. Connection is made by an intermediate roof framing member 48 fixed to member 38*a* and bolted to the tower 22 by bolts 57. Attached to the other end of the framing member 38 is a cable 40 which is now pulled to the top of the tower by top crane 34 or by ground crane 30 where it is tensioned by hydraulic jacks and connected to the tower. The cable 40 is of prescribed length and fitted with anchor sockets at both ends. By the use of prefabricated length cables, cables can be later exchanged if needed in the event of damage or corrosion. Such cables may be of the fully galvanized locked-wire type and installed with sufficient tension to provide a tight seal against water intrusion and in turn corrosion or they may be protected by a cover for corrosion protection or they may be of other construction. To install and make tight such cables, a typical end socket is fitted with an extension rod screwed into the end of the cable socket. The cable and rod then can be pulled into place by a winch or pulley and by the top crane 34 or ground crane 30 allowing sufficient sag so that the force to pull the cable and rod can be reasonably handled. Once in place with the cable rod extension in a hydraulic press mounted in the tower, the rod extension is then pulled by the hydraulic press or jack to the very high tension and low sag of the final cable configuration and the cable socket is then firmly anchored in the cable anchorage and the rod extension removed. Shims can then be installed at the socket anchorage to make minor adjustment and the connection of the socket to the structure can also be adjusted by a threaded bolt attached to the outside of the socket to which the connection of the cable to its anchorage is made. In such a manner then the first long-beam framing member is installed and connected to the tower by its Cable-Stay. The cable referred to may be one cable or a multiple of cables grouped together. The aforedescribed tensioning and anchorage structure is well known and not unique to the present invention. Accordingly, it has not been illustrated.

Thereafter a back-stay cable 42 is installed in like manner between the anchorage and the tower. The back-stay cables as well may be singular cables or multiple cables. All cables are of fixed length with sockets at both ends. The cables may be sloped at the angle shown or may be sloped at a steeper angle so that the anchors are closer to the stadium. The back-stay cables may also be sloped at a flatter angle placing the anchors at a further distance from the stadium than shown. The cables can be attached first at either the tower or at the anchorage and then pulled into place at the opposite end by the method described above. The cables can be supported on a temporary falsework or scaffolding or a suspended cable construction footwalk for their erection, or they can be installed without these measures.

Figure 10:
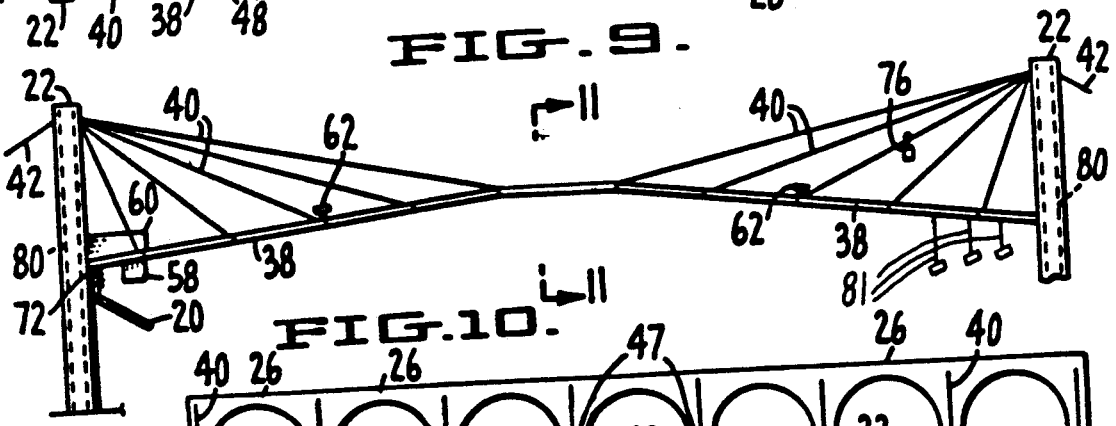
FIG. 10 is an elevational sectional view through the center of the roof showing water jets on the roof, a boatswains chair or basket on the cables for access, a roof restaurant, a flexible closure gasket between the roof edge and the stadium, suspended luxury seating boxes, and suspended infrared radiant heaters.
Figure 11:
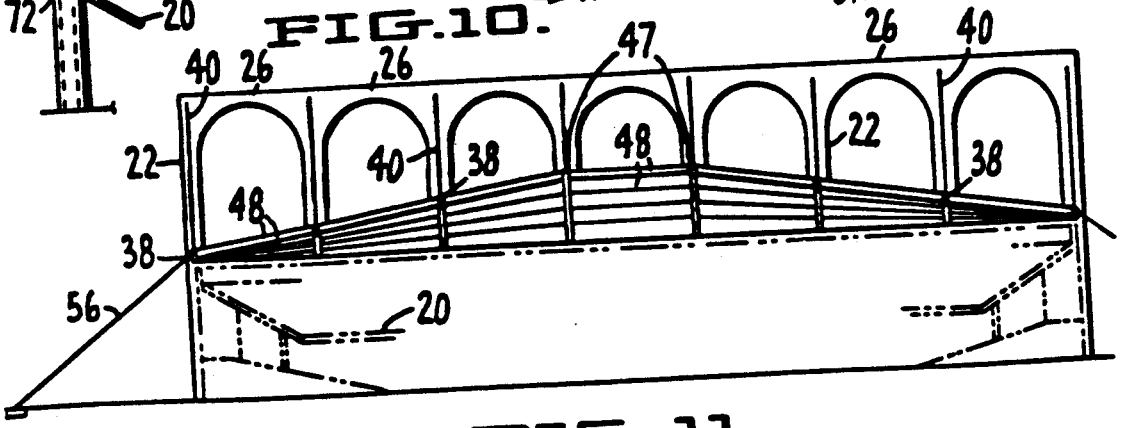
FIG. 11 a cross-sectional view taken on line 11—11 of FIG. 10, also showing hold down and sidesway cables.

The cables, as stated, can be either singular or multiple cables. Where they are multiple cables they are connected together at intermediate points. A boatswains chair or basket suspended from the cables may be used for access to perform this operation. See 76 in FIG. 10.

The cables after they are installed receive a final coat of paint. A boatswains chair may be used again which may also later be used for repainting and inspection. Other types of cables other than described may also be used, and the method of installation may vary, but the end configuration is not changed.

For an example the cables might be fabricated to be continuous over the towers supported on saddle supports in the towers and then connected at one end to a long-beam framing member 38 and the other end to a ground anchorage 28 and then tensioned at one or the other end.

For another example, the tensioning of the cables may be made by jacking the cable support in the tower upward either in addition to the tensioning made at the ends of the cables or entirely in this manner.

Figure 12:
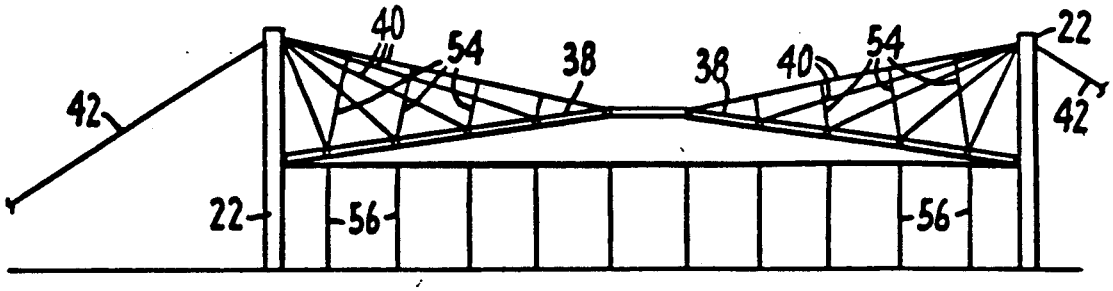
FIG. 12 is a view similar to FIG. 10, but also showing hold down sidesway cables at the roof's edge. Also shown are cross-cables or struts between the Cable-Stays to limit wind structural vibration of the cables, to control cable vibration noise control, and to enhance roof stiffness. These cables might not be needed.

After all cables are installed the cables may be connected between Cable-Stays by other cross-cables 54 or by struts 54 to dampen any wind induced or earthquake induced vibrations which could develop. (see FIG. 12). This also increases the general stiffness of the roof. Vibration dampers consisting of shock absorbers or rubber ring dampers may also be installed at the cable connection points.

Figure 8:
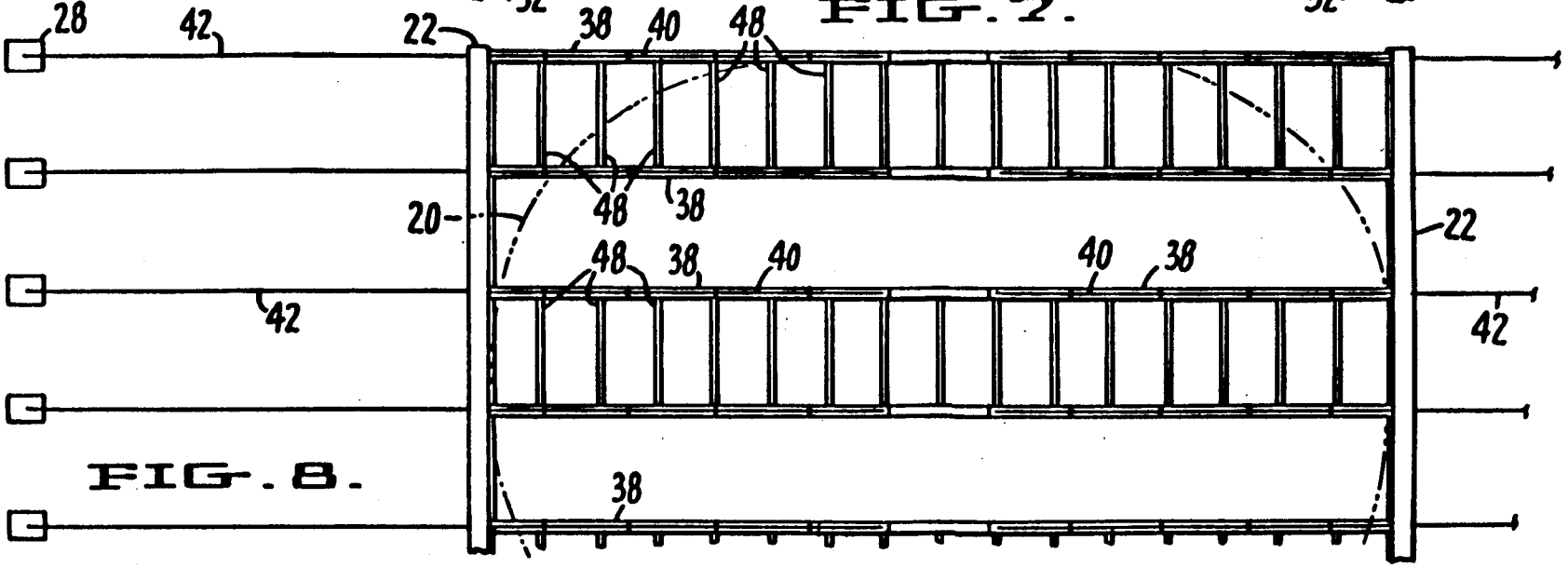
FIG. 8 is a plan view of an intermediate first stage of the roof construction, showing every other roof section constructed.

Now after the initial long-beam framing member 38*a* is installed as described to this point, FIG. 3, a second is installed in like manner from the next adjacent tower leg and intermediate framing 48 is installed, as seen in FIG. 8, by being secured between the long-beam framing members 38. The intermediate framing 48 may be of many different types. It may be open web steel joists, a space frame, or tubular steel joists, or wide flange steel beams, or any other framing system. A tubular steel system is shown in the drawings for the intermediate framing system. The intermediate roof framing 48 by definition is all framing located between the roof long-beam framing members 38.

A safety net is now installed to extend under all cantilevered construction.

Figure 9:
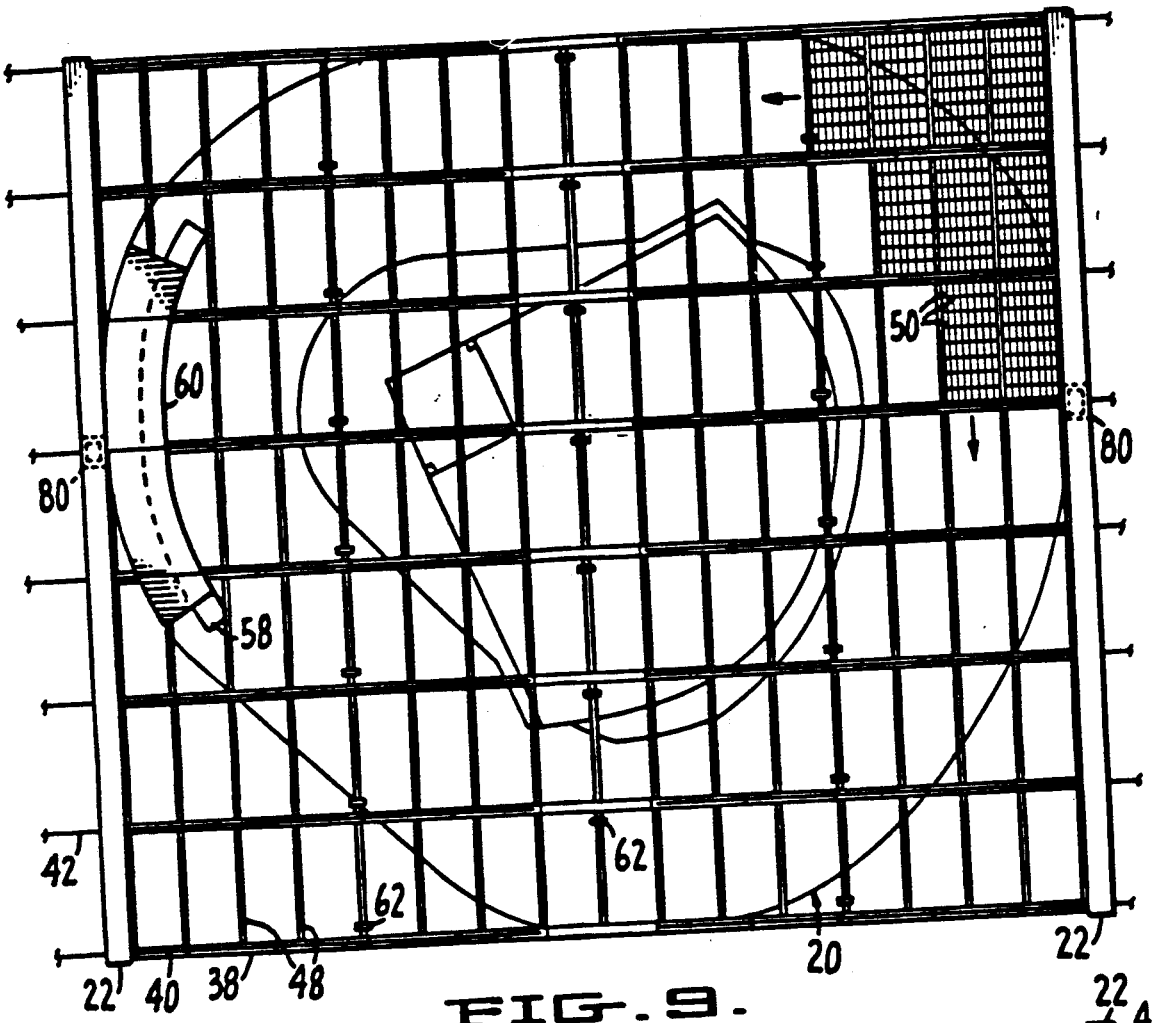
FIG. 9 is a plan view of the roof with all sections completed, including a roof restaurant, luxury seating boxes, water jets for cleaning, beam walkways, and different forms of roof retractability or partial opening.
Figure 16:
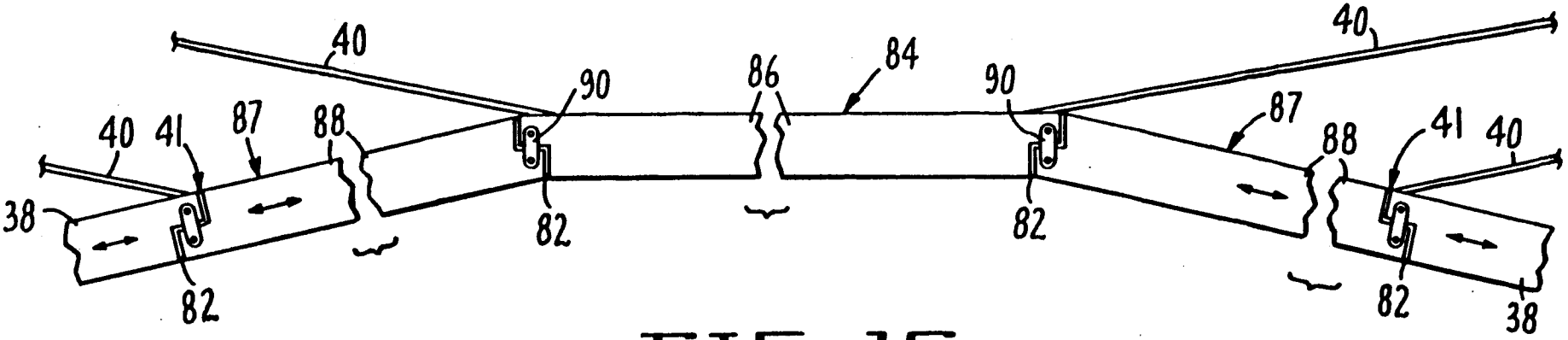
FIG. 16 shows the central long-beam framing member with infill long-beam framing members on either side connected with expansion and contraction joints between the central long-beam framing member and the cantilevered long-beam framing members.
Figure 17:
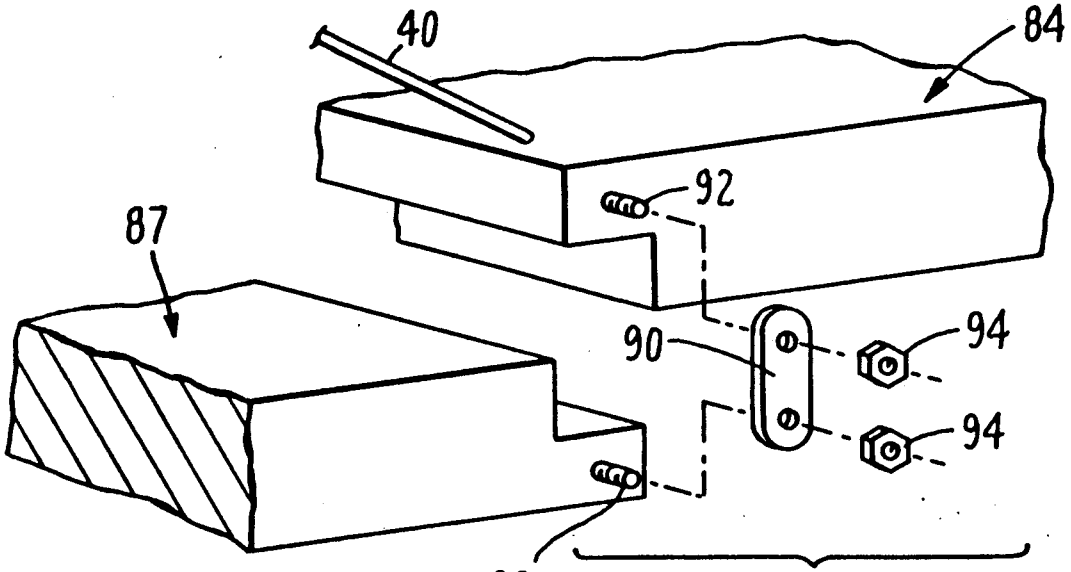
FIG. 17 is an exploded perspective view of the connection for the infill framing members shown in FIG. 16.

The roof construction now proceeds in similar fashion as by the initial framing member installation described above, but with each successive long-beam framing member attached to the end of the last installed long-beam framing member. The procedure repeats itself until one cantilevered section is built out to its distal edge 41. At the open span gap 43 a central long-beam framing member 86 is suspended in tension between the long-beam framing members 38 by Cable-Stays 40 extending to the tower tops. Between this central member 86 and the cantilevered long-beam framing members 38, infill long-beam framing members 88 are installed and connected with connections at either end or at both ends to allow for expansion and contraction from temperature and possibly earthquake and wind and other forces relative movement (see FIG. 16). In this manner the roof is successively built out over the stadium. Alternate sections which might be 100 feet in width are built first so that the constructed unit hangs evenly. Two completed cantilevered sections together with the central intermediate section 84 and infill roof members 87 may be 848' in length spanning the stadium or arena. After the alternate sections are so constructed, FIG. 8, the intermediate framing 48 is installed in these intermediate sections in like manner as the installation of the adjacent framing again using the ground cranes and where desired the top cranes or no top cranes to finish the roof, FIG. 9.

The roof is constructed as above from two sides of the stadium and spanned at the middle by the intermediate section 84 and infill members 87. It is built either from both sides simultaneously or one side at a time.

Now hold-down and sidesway cables 56 are installed as needed between the roof edge and the ground or stadium structure From FIG. 1 it will be seen that the long-beams 38 and the resultant roof sections slope upward from the towers to the central portion of the roof and that the roof also slopes laterally from the central area to the edges. The outermost beams 38 to which the cables 58 are joined are essentially horizontal.

After the entire roof framing is installed, checked, and adjusted, and painted, the roof covering 50 and the retractable or openable elements and louvered sections are installed. This is accomplished either by hoisting the materials of the roof cover onto the roof by the ground or top cranes, or by lowering the materials onto the roof by helicopter. The retractable or openable sections are also lifted into place in the same manner and installed.

Figure 14:
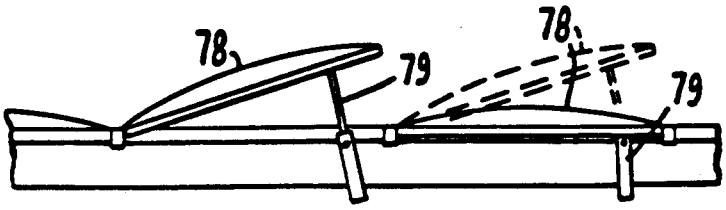
FIG. 14 is a cross-sectional view taken on line 14—14 of FIG. 13, showing the operable hinged method of opening of each skylight by remote control.

The roof is made retractable by allowing any number of roof sections either contiguous or spaced to slide over other roof sections and to be controlled either manually or by remote means. Such sections are designated 50*a* in FIG. 13. The remote control opening mechanism may be a hydraulic ram system to open and close the roof or it may be a mechanical cable controlled system. Retractability or ventilation opening may also be achieved by a hinged door type opening also remotely controlled activated by electric, hydraulic, air, or other control mechanism. Such openings may be seen in FIGS. 14 and 15 wherein bubble panels 78 are hinged at one edge to framing 48 and may be selectively engaged or raised from engagement with adjacent framing by hydraulic cylinders 79 or by similar electric motor and gear, or an air pressure operated mechanism, or by other means. The roof cover 50 may also be made with louvers to allow for ventilation and, if desired, portions of the roof cover may be made permanently open in certain areas.

Suspended from the roof and balcony of the stadium are infrared heaters 81 to provide radiant heat where needed to the stadium.

The roof as so constructed overlaps the stadium rim in such a manner that no rain and only minor amounts of wind can enter, but ventilation can occur. (see FIG. 9). The roof is left unconnected to the stadium to allow for independent structural movement. The roof overlaps the rim of the stadium to provide some protection to the concourse and other areas around the stadium.

The space between the roof and the stadium rim is made of sufficient size, possibly 8', to allow for desired ventilation. The roof, however, may be connected at this point to the stadium if so desired and the space may be closed. The closure may be a flexible gasket. See 72 FIG. 10.

Stadium stanchion lighting 73 (see FIG. 1) where existing is left in place or where interference with the roof tower assembly 22 and 26 occurs, remounted on the roof tower assembly. These lights can then project through the completed clear skylight roof illuminating the stadium interior. Additional lighting if necessary can be installed on the underside of the roof structure.

Additional details of construction include: roof drainage and downspouts (not illustrated) roof condensation gutters on the underside of the roof (not illustrated) high pressure water cleaning jets 62 on the roof for cleaning; elevators 80 installed in the towers for access to the top of the towers and the roof; walkways and handrails formed on the tower tops and on the roof beams 38 for maintenance and sightseeing; a restaurant 60 constructed on the roof (see FIGS. 9 and 10); and luxury boxes 58 for private seating built on the roof or suspended from the roof.

It is to be understood that while the subject invention has been described with reference to a preferred method of assembly, other variations could be made by one skilled in the art without varying from the scope and the spirit of the subject invention as defined by the appended claims.

What is claimed is:

1. A method of constructing a roof over a stadium or arena, said method comprising:

(a) erecting a first row of cable stay towers outside one side of the stadium or arena;

(b) erecting a second row of cable stay towers outside of the stadium or arena opposite said one side;

(c) cantilevering roof structure from each row of said towers by progressively extending sections of said structure from said towers and over the stadium or arena while suspending each successive section by a cable stay connection to the tower from which the section extends;

(d) terminating the roof structure cantilevered from each row of towers at a distal edge spaced from the distal edge of the roof structure cantilevered from the other row of towers to provide an open span gap between the respective roof structures cantilevered from the towers; and, (e) suspending an intermediate roof section within the gap between the cantilevered roof sections by cable stays extending to the respective rows of towers.

2. A method according to claim 1 wherein the roof structure is cantilevered from the towers by the following steps:

(i) preconstructing and disposing the roof sections at staging areas located at the foot of the towers or on the floor of the stadium;

(ii) lifting the sections onto the towers and roof by ground located cranes;

(iii) initially suspending the sections in cantilevered relationship to the towers by ground located cranes;

(iv) connecting the suspended roof sections by cable stays to the towers by the use of a crane; and, (v) successively placing the sections in cantilevered relationship by ground cranes operating from the floor of the stadium or arena and successively connecting cable stays to the towers by the use of cranes.

3. A method according to claim 1 further comprising providing a seal between the cantilevered roof structure and the intermediate roof section.

4. A method of spanning spaced cantilevered cable stay supported roof structures extended from towers set outside a stadium or arena to close a roof over the stadium or arena, said method comprising:

(a) suspending an intermediate roof member between the cantilevered roof structures by cable stays to towers outside the stadium or arena;

(b) providing infill roof members between the intermediate roof member and the cantilevered roof structures; and, (c) securing the infill roof members to the cantilevered roof structures and the intermediate roof member through expansion and contraction joints.

5. A roof structure for use over an open topped stadium, said structure comprising:

(a) a first row of cable stay towers located outside one side of the stadium;

(b) a second row of cable stay towers located outside the stadium to the side thereof opposite said one side;

(c) a first roof section cantilevered from the first row of towers and extending therefrom partially over the stadium and toward the second row of towers, said first roof section being disposed in compression imparting relationship to the first row of towers;

(d) a second roof section cantilevered from the second row of towers and extending therefrom partially over the stadium and toward the first row of towers, said second roof section being disposed in compression imparting relationship to the second row of towers and said first and second roof sections having spaced distal edges defining a open span gap therebetween;

(e) first cable stay means extending from each row of said towers to suspend the load of the roof section cantilevered therefrom;

(f) second cable stay means extending from each row of said towers to counterbalance the load imparted to the towers by the first cable stay means;

(g) an intermediate roof section disposed between the first and second roof sections to at least partially close the gap therebetween; and, (h) cable stays suspending the intermediate roof section in tension between the first and second rows of towers to support the intermediate section without imparting substantial loading to the first and second roof sections.

6. A roof structure according to claim 5 wherein the intermediate roof section is suspended between the first and second roof sections so as to be spaced therefrom, said structure further comprising fill panels suspended between the first and second roof sections and the intermediate roof section.

7. A roof structure according to claim 6 further comprising link means securing the fill panels between the first and second roof sections and the intermediate roof section to permit limited lateral movement of the first and second roof sections relative to one another and the intermediate roof section, while holding the fill panels in suspended relationship.

8. A method of constructing a roof over a stadium, said method comprising:

(a) erecting a first row of cable stay towers outside one side of the stadium;

(b) erecting a second row of cable stay towers outside the side of the stadium opposite said one side;

(c) cantilevering elongate roof members in parallel from each row of said towers by progressively extending sections of said members from said towers and over the stadium while suspending each successive section by a first cable stay means connected to the tower from which the section extends by the following steps:

(i) preconstructing and disposing the roof member sections at staging areas at the site of the stadium (ii) lifting the sections onto the towers and roof by ground located cranes;

(ii) initially suspending the sections in cantilevered relationship to the towers by ground located cranes;

(iv) connecting the suspended sections by cable stays to the towers by use of a crane;

(v) successively placing the sections in cantilevered relationship by ground cranes operating from the floor of the stadium or arena and successively connecting cable stays to the towers by the use of cranes;

(vi) successively placing the sections in parallel so the sections along the edge of the stadium roof are horizontal and those sections in the interior area of the roof are raised progressively from the sides to the center area of the roof to provide a dome shaped roof structure made of straight sections;

(vii) connecting by the use of towers and ground cranes second cable stay means from each row of said towers to counterbalance the load imparted to the towers by the first cable stay means; and, (d) spanning the roof structures cantilevered from the rows of towers to provide a cover over the stadium.

* * * * *